US006402021B1

(12) United States Patent
Heathcock

(10) Patent No.: US 6,402,021 B1
(45) Date of Patent: Jun. 11, 2002

(54) DISPLAYABLE SHIPPING CARTON

(75) Inventor: John A. Heathcock, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 14 days.

(21) Appl. No.: 09/912,780

(22) Filed: Jul. 25, 2001

(51) Int. Cl.[7] ..... B65D 17/28

(52) U.S. Cl. ..... 229/242; 53/492; 229/117.16; 229/160.2; 229/240; 229/925

(58) Field of Search ..... 229/117.16, 160.2, 229/164, 240, 241, 242, 924, 925; 206/736; 53/492; 493/56, 63

(56) References Cited

U.S. PATENT DOCUMENTS

| | | | | |
|---|---|---|---|---|
| 1,600,538 A | | 9/1926 | Dollahite | |
| 1,986,101 A | | 1/1935 | Brodsky | |
| 2,547,892 A | | 4/1951 | Stevens | |
| 3,160,274 A | | 12/1964 | Pritchard | |
| 3,854,652 A | * | 12/1974 | Brachmann et al. | 229/117.16 |
| 3,961,706 A | | 6/1976 | Roccaforte et al. | |
| 4,058,206 A | * | 11/1977 | Morse et al. | 229/240 |
| 4,318,474 A | * | 3/1982 | Hasegawa | 229/117.16 |
| 4,378,877 A | | 4/1983 | Botterman et al. | |
| 4,488,641 A | * | 12/1984 | Nishiguchi et al. | 206/736 |
| 4,946,042 A | * | 8/1990 | Ferreri et al. | 229/242 |
| 5,078,273 A | * | 1/1992 | Kuchenbecker | 229/924 |
| 5,188,285 A | * | 2/1993 | Nilssen et al. | 229/240 |
| 5,690,230 A | | 11/1997 | Griffith | |
| 5,881,884 A | | 3/1999 | Podosek | |
| 5,918,801 A | | 7/1999 | Milio | |
| 5,957,294 A | | 9/1999 | Kanter | |
| 6,098,874 A | * | 8/2000 | Tokarski | 229/241 |
| 6,138,905 A | | 10/2000 | Hachenski | |
| 6,155,480 A | | 12/2000 | Botsford et al. | |
| 6,209,786 B1 | | 4/2001 | Yelton et al. | |

* cited by examiner

*Primary Examiner*—Gary E. Elkins

(57) ABSTRACT

A generally rectangular carton for containing and displaying a product has a bottom, a first side, a second side, a front, a top, and a rear which collectively define an interior space of the carton. The front has a handle opening through an interior portion thereof. The carton has a combination of lines of perforations whereby a user can grab a front tear section of the carton by way of the opening in the front and pull the front tear away section in a first direction up from the front and in a second direction away from the front so as to remove the front tear away section, the top and optionally, a rear tear away section from the carton.

14 Claims, 2 Drawing Sheets

DISPLAYABLE SHIPPING CARTON

BACKGROUND OF THE INVENTION

1. Field of the Invention

This invention relates primarily to cartons for displaying products sold at retail, such as aerosol cans containing personal care products, and more particularly, to a carton having top and side panel(s) that may be easily removed at a display location so that at least part of the product can be viewed by prospective buyers without the store owner having to remove the product from the carton.

2. Description of the Related Art

After being manufactured, retail products, such as aerosol cans containing shaving cream, hair spray, deodorant and the like, are commonly packaged in a generally rectangular carton for containing, transporting, and preferably, displaying the product at a retail location. Frequently, retailers want to display such products so that at least a part of the appearance of the product can be viewed by prospective buyers. However, retailers do not want the added expense of removing the products from the carton and placing the products on a display shelf. Therefore, carton configurations have been proposed that allow a retailer to remove a portion of a carton and place the remaining carton on a display shelf so that a consumer may view the product and readily remove the product from the carton. See, e.g., U.S. Pat. Nos. 6,209,789, 5,957,294 and 5,918,801 which show cartons with removable tear strips, and U.S. Pat. Nos. 6,155,480, 5,690,230, 3,961,274, and 2,547,892 which show cartons with tear away sections. Some of these cartons are expensive to produce. In particular, cartons having surrounding removable tear strips are quite expensive.

While these and other carton configurations have been proposed for the display and easy removal of a product contained in a carton, there is a continuing need for a carton having a configuration that allows the carton to be loaded with a product at a manufacturing site and transported to a retail location where a retailer may readily detach the top and at least a part of a side of the carton. The retailer may then place the opened carton on a shelf so that a consumer may view at least part of the product and remove the product from the carton for purchase.

BRIEF SUMMARY OF THE INVENTION

The foregoing needs are met by a carton for containing and displaying a product according to the invention which includes a bottom, a first side, a second side, a front having an opening through an interior portion thereof, a top, and a rear. The bottom, the first side, the second side, the front, the top and the rear collectively define an interior space of the carton. The first side, the second side, the front, and the rear are joined at their lower edges to at least a portion of the bottom, and the front and the rear are joined at their upper edges to at least a portion of the top The first side is joined at its upper edge to the top by a first line of perforations, and the second side is joined at its upper edge to the top by a second line of perforations The first side and the second side are joined at their front edges to the front, and the first side and the second side are joined at their rear edges to the rear. The front includes a third line of perforations extending from the opening in the front to the first line of perforations and a fourth line of perforations extending from the opening in the front to the second line of perforations. The third line of perforations, the fourth line of perforations, the upper edge of the front, and an edge of the opening in the front define a perimeter of a front tear away section. The rear includes a fifth line of perforations extending from the first line of perforations to the second line of perforations.

The carton is typically loaded with a product at a manufacturing site and transported to a retail location where a retailer may grasp the front tear away section of the carton by way of the handle opening and pull the front tear away section in a first direction up from the front and in a second direction away from the front so as to remove the front tear away section and the top from the carton. The retailer may then place the opened carton on a shelf so that a consumer may view at least part of the product and remove the product from the carton for purchase.

In another aspect, the invention comprises a one-piece foldable blank for forming the carton.

In yet another aspect, the invention comprises a method for forming a display carton. In the method, a carton including a bottom, a first side, a second side, a front having an opening through an interior portion thereof, a top, and a rear is first provided. The bottom, the first side, the second side, the front, the top and the rear collectively define an interior space of the carton. The first side, the second side, the front, and the rear are joined at their lower edges to at least a portion of the bottom, and the front and the rear are joined at their upper edges to at least a portion of the top. The first side is joined at its upper edge to the top by a first line of perforations, and the second side is joined at its upper edge to the top by a second line of perforations. The first side and the second side are joined at their front edges to the front, and the first side and the second side are joined at their rear edges to the rear. The front includes a third line of perforations extending from the opening in the front to the first line of perforations and a fourth line of perforations extending from the opening in the front to the second line of perforations. The third line of perforations, the fourth line of perforations, the upper edge of the front, and an edge of the opening in the front define a perimeter of a front tear away section. The rear includes a fifth line of perforations extending from the first line of perforations to the second line of perforations. The front tear away section of the carton is grasped by way of the opening, and pulled in a first direction up from the front and in a second direction away from the front so as to remove the front tear away section and the top to form the display carton.

In still another aspect, the invention comprises a display carton formed by the method.

It is therefore an advantage of the present invention to provide a carton that allows retailers to display a product so that at least a part of the appearance of the product can be viewed by prospective buyers.

It is another advantage of the present invention to provide a carton having a configuration that allows the carton to be loaded with a product at a manufacturing site and transported to a retail location where a retailer may readily detach the top and at least a part of a side of the carton.

It is yet another advantage of the present invention to provide a carton having a configuration that allows a retailer to readily detach the top and at least a part of a side of the carton to display at least a part of the product on a shelf without the need to remove the product from the carton.

These and other features, aspects, and advantages of the present invention will become better understood upon consideration of the following detailed description, drawings, and appended claims.

It should be understood, of course, that the invention is not necessarily limited to the particular embodiments illustrated herein.

DETAILED DESCRIPTION

Figure 1:
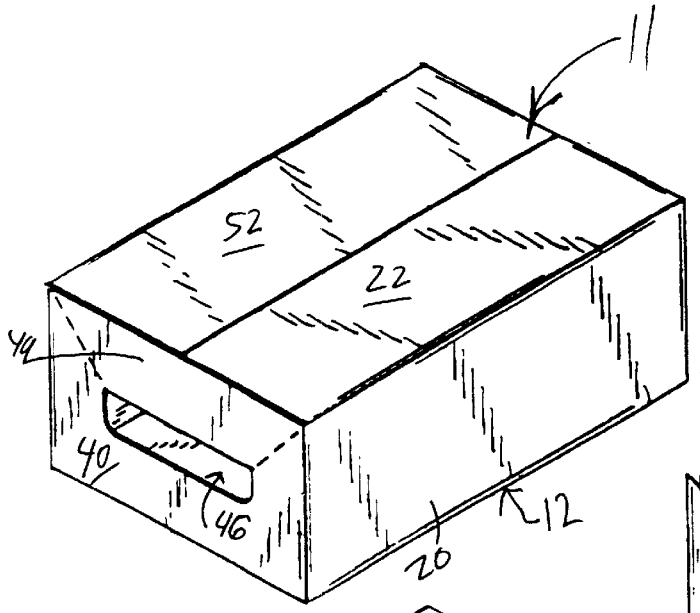
FIG. 1 is a front perspective view from above and to one side of a displayable shipping carton in accordance with the invention.
Figure 3:
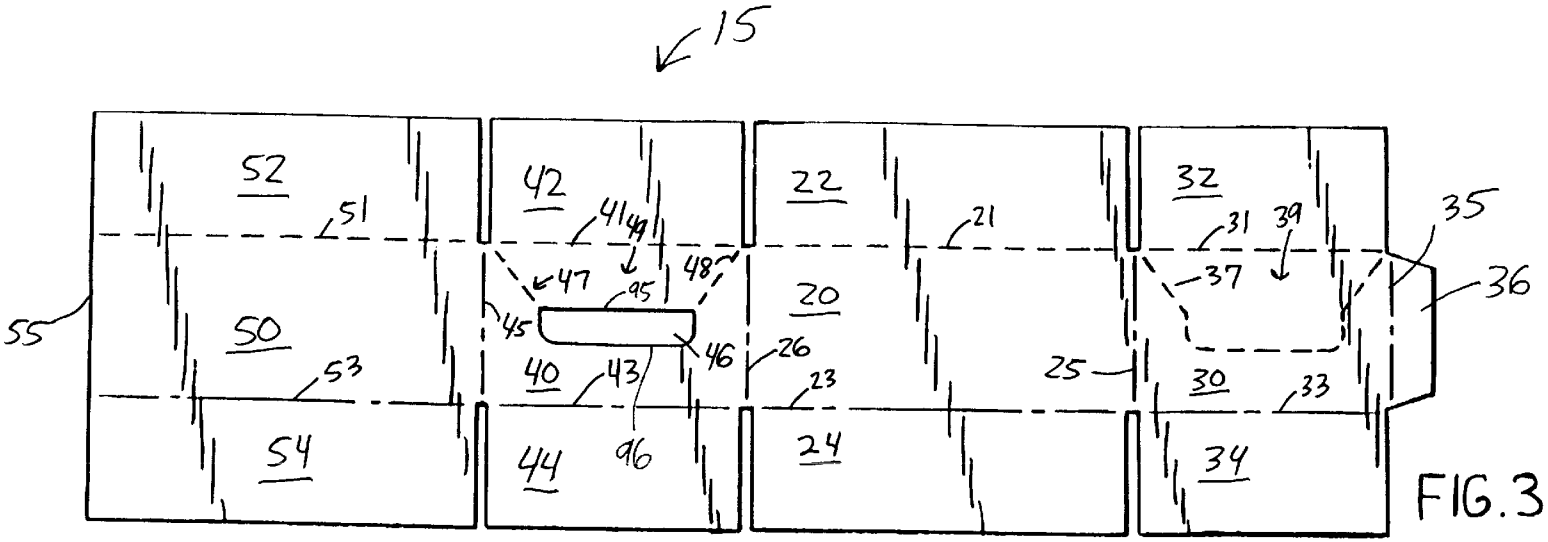
FIG. 3 is a side view showing a blank suitable to form the displayable shipping carton shown in FIGS. 1 and 2.

Referring now to FIG. 3, there is shown a single planar blank of carton material indicated generally at 15 that may be assembled into a displayable shipping carton according to the invention as shown in FIG. 1. The carton material may be cardboard, corrugated paperboard, stiffened plastic sheeting, or other any other conventional carton material. The blank 15 can be formed by the use of a single die having sharp blade edges to make cuts through the carton material, as illustrated by solid lines in FIG. 3 or lines of perforations (which are alternating cuts and skips), as illustrated by dashed lines in FIG. 3, and blunted edges that are pressed into the carton material to form crease lines, at illustrated by broken lines in FIG. 3. The blank 15 can then be folded along the crease lines and selected flaps of the blank 15 can be secured to selected panels by conventional means, such as gluing or stapling, to form the carton 10 of FIG. 1.

The blank 15 includes a front panel 40, a top right panel 22, a top left panel 52, a right panel 20, a left panel 50, a rear panel 30, a bottom right panel 24 and a bottom left panel 54. When the blank 15 is assembled into a carton 10 according to the invention, the front panel 40, the right panel 20, the left panel 50, and the rear panel 30 form the front, right, left, and rear of the carton, the top right panel 22 and the top left panel 52 form the top of the carton, and the bottom right panel 24 and the bottom left panel 54 form the bottom of the carton. It should be understood that when describing the panels of the blank or the sides of the carton, the terms front, right, left, rear, bottom and top have been used for convenience and do not imply that the carton must be arranged with the front of the display carton facing a viewer. However, in an example use for the display carton, a viewer facing the display carton would be looking at the front of the carton, with the bottom of the carton typically resting on a display surface. In addition, when the term "substantially" is used herein with reference to the shape of carton features, the term "substantially" means that the feature may vary slightly from the general geometric shape.

The front panel 40 is hinged to the left panel 50 by a crease line 45, is hinged to the right panel 20 by a crease line 26, is hinged to a bottom front assembly flap 44 by a crease line 43, and is hinged to a top front assembly flap 42 by a line of perforations 41. The front panel 40 includes an opening 46 defined by a substantially linear top edge 95 and a substantially U-shaped lower edge 96. The lowermost portion of the U-shaped lower edge 96 preferably extends downward to a position more than half way down from the line of perforations 41 to the crease line 48. A line of perforations 47 extends from an upper left corner of the opening 46 in the front panel 40 to the junction of the crease line 45 and the line of perforations 41 in the upper left corner of the front panel 40. A line of perforations 48 extends from an upper right corner of the opening 46 in the front panel 40 to the junction of the crease line 26 and the line of perforations 41 in the upper right corner of the front panel 40. The top edge 95 of the opening 46, the line of perforations 47, the line of perforations 41 and the line of perforations 48 define a removable tear away section 49 in the front panel 40.

The left panel 50 is hinged to the bottom left panel 54 by a crease line 53 and is hinged to the top left panel 52 by a line of perforations 51. The right panel 20 is hinged to the rear panel 30 by a crease line 25, is hinged to the bottom right panel 24 by a crease line 23, and is hinged to the top right panel 22 by a line of perforations 21. The rear panel 30 is hinged to a rear bottom assembly flap 34 by a crease line 33, is hinged to a top rear assembly flap 32 by a line of perforations 31, and is hinged to a left rear assembly flap 36 by a crease line 35. A line of perforations 37 extends from the junction of the crease line 25 and the line of perforations 31 in the upper left corner of the rear panel 30 to a central region of the rear panel 30 and to the junction of the crease line 35 and the line of perforations 31 in the upper right corner of the rear panel 30. The line of perforations 31 and the line of perforations 37 define a removable tear away section 39 in the rear panel 30. Preferably, the line of perforations 37 extends downward to a position more than half way down from the line of perforations 31 to the crease line 33. Most preferably, the line of perforations 37 has a shape substantially approximating that of the combination the line of perforations 47, the U-shaped lower edge 96 of the opening 46 in the front panel 40 and the line of perforations 48.

Figure 2:
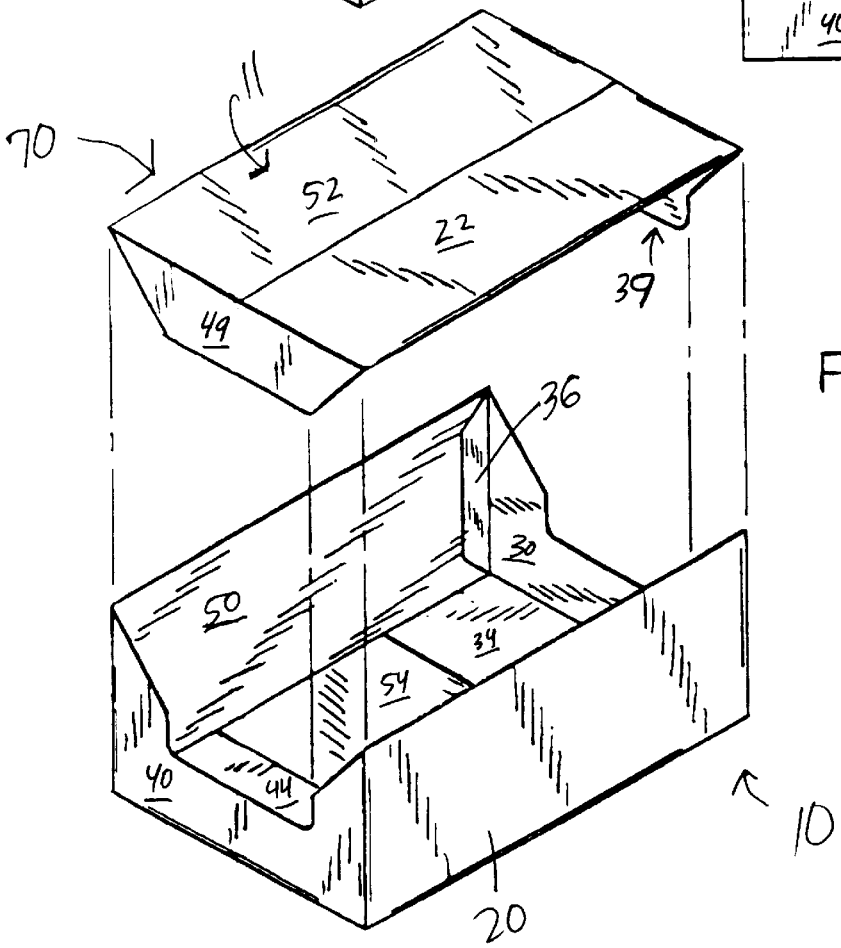
FIG. 2 is an exploded front perspective view from above and to one side of a displayable shipping carton in accordance with the invention having the top and part of the front and back of the carton removed.

The blank 15 of FIG. 3 can be assembled into the generally rectangular carton 10 shown in FIGS. 1 and 2 using (among other methods) the following manual steps (the sequence of which can be altered). First, the left rear assembly flap 36 is folded 90 degrees rearward (i.e., into the plane of the drawing of FIG. 3) along crease line 35. The rear panel 30 is then folded 90 degrees rearward (i.e., into the plane of the drawing of FIG. 3) along crease line 25 and then the right panel 20 is folded 90 degrees rearward (i.e., into the plane of the drawing of FIG. 3) along crease line 26. The left panel 50 is then folded 90 degrees rearward (i.e., into the plane of the drawing of FIG. 3) along crease line 45. The left rear assembly flap 36 may then be secured (such as by gluing or stapling) to the interior of the left panel 50 near the back edge 55 of the left panel 50.

Next, the top front assembly flap 42 is folded 90 degrees downward towards the interior of the carton along line of perforations 41, and the top rear assembly flap 32 is folded 90 degrees downward towards the interior of the carton along line of perforations 31. Glue may then be applied to the top surfaces of the top front assembly flap 42 and the top rear assembly flap 32, and the top right panel 22 is folded 90 degrees downward towards the interior of the carton along line of perforations 21 and the top left panel 52 is folded 90 degrees downward towards the interior of the carton along line of perforations 51 thereby securing the top left panel 52 and top right panel 22 in side by side relationship to form the top 11 of the carton 10 as shown in FIGS. 1 and 2. It can be seen that the top left panel 52 and the top right panel 22 are arranged in side by side relationship without any overlap that could affect the flatness of the top 11 of the carton 10. (Of course, automated methods may also be used to assemble the carton.)

The partially assembled carton is then turned over so that the top 11 of the carton 10 rests on the assembly surface. Product may then be inserted in the interior of the partially assembled carton. Next, the bottom front assembly flap 44 is folded 90 degrees downward towards the interior of the partially assembled carton along crease line 43, and the bottom rear assembly flap 34 is folded 90 degrees downward towards the interior of the partially assembled carton along crease line 33. Glue may then be applied to the top surfaces of the bottom front assembly flap 44 and the bottom rear assembly flap 34, and the bottom right panel 24 is folded 90 degrees downward towards the interior of the partially assembled carton along crease line 23 and the bottom left panel 54 is folded 90 degrees downward towards the interior of the partially assembled carton along crease line 53 thereby securing the bottom left panel 54 and bottom right panel 24 in side by side relationship to form the bottom side 12 of the carton 10 as shown in FIGS. 1 and 2. It can be seen that the bottom left panel 54 and the bottom right panel 24 are arranged in side by side relationship without any overlap that could affect the flatness of the bottom 12 of the carton. The assembled carton 10 may then be turned over so that the bottom 12 rests on the assembly surface.

After this assembly process, the carton 10 will be configured as shown in FIG. 1 (a shipping/storage configuration). The carton 10 would then be shipped to a retail location with product loaded therein. The carton 10 is then typically placed on a flat surface by a retailer with the bottom 12 of the carton 10 resting on the flat surface. The retailer may grasp the front tear away section 49 of the carton by way of the handle opening 46 in the front panel 40 and pull the front tear away section 49 in a first direction up from the front panel 40 and in a second direction away from the front panel 40 so as to remove the carton tear away section 70 shown in FIG. 2 from the carton 10.

Figure 5:
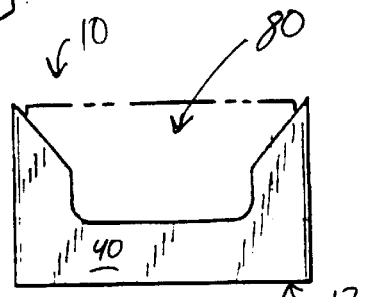
FIG. 5 is a front elevational view of the carton of FIGS. 1 and 2 containing a product shown in phantom lines.
Figure 4:
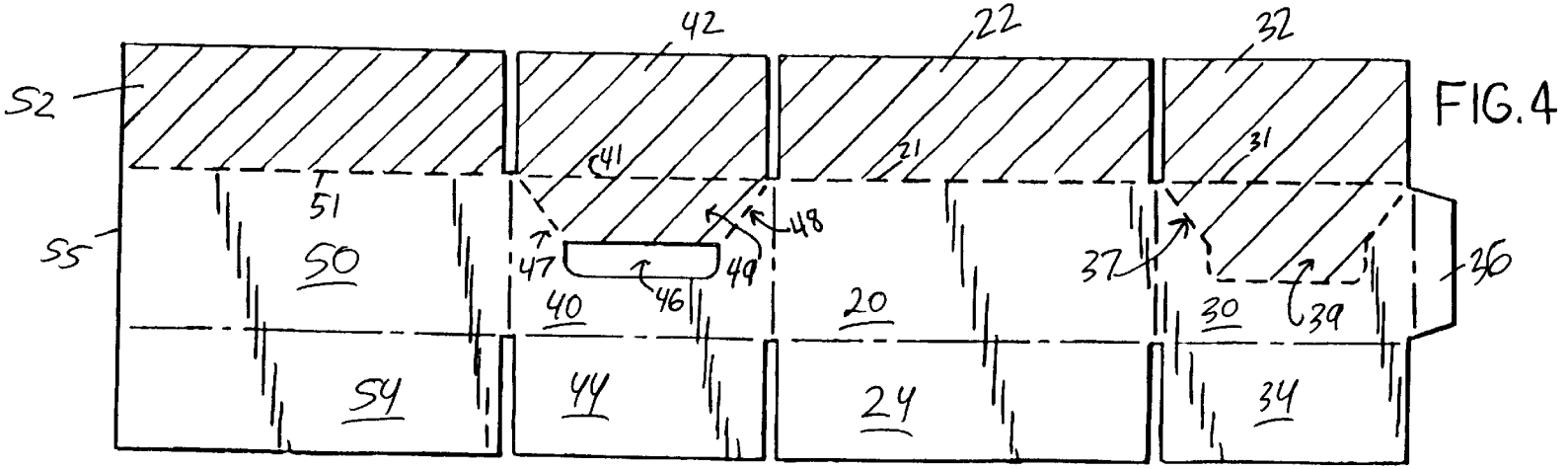
FIG. 4 is similar to FIG. 3 but with the removable sections of carton material being shown cross-hatched.

It can be seen that the carton tear away section 70 comprises the front tear away section 49, the top 11 and the rear tear away section 39 Looking at FIG. 4, it can also be seen that the tear away sections of the carton 10 include the front tear away section 49, the rear tear away section 39, and the top left panel 52, the top right panel 22, the top front assembly flap 42 and the top rear assembly flap 32 which comprise the top 11 of the carton 10. (These tear away sections are cross-hatched in FIG. 4). The retailer may then place the opened carton on a shelf as shown in FIG. 5 so that a consumer may view at least part of the product 80 and remove the product 80 from the carton 10 for purchase.

The carton has many beneficial features that increase the ease of use of the carton and that provide enhanced display capabilities. For example, the opening 46 in the front panel 40 allows a user to easily grasp the front tear away section 49 and remove the remove the front tear away section 49, the top side 11 and the rear tear away section 39 from the carton 10. In other similar cartons, a user often has to manually create an opening in the carton before removing any tear away sections. The opening 46 also serves to act as a handle thereby assisting in the lifting of the carton 10. Also, the top left panel 52 and the top right panel 22 are arranged in side by side relationship without any overlap that could affect the flatness of the top 11 of the carton. This provides for easier stacking of the carton 10. Furthermore, the line of perforations 37 in the rear panel 30 has a shape substantially approximating that of the combination the line of perforations 47, the lower edge 96 of the opening 46 in the front panel 40 and the line of perforations 48. This provides for easier unloading of bulky products.

It can also be seen from FIG. 3 that the lower edge 96 of the opening 46 extends downward to a position more than half way down from the line of perforations 41 to the crease line 43. This provides for increased product display capabilities. It can further be seen from FIG. 3 that the line of perforations 37 extends downward to a position more than half way down from the line of perforations 31 to the crease line 33. This also makes it easier to remove products contained at the rear of the carton 10. In addition, by providing the line of perforations 47 which extends from one end of the upper edge 95 of the opening 46 to the line of perforations 51 and by providing the line of perforations 48 which extends from the opposite second end of the upper edge 95 of the opening 46 to the line of perforations 21, the tear away section 70 may be removed more easily from the carton 10.

Various modifications of the carton 10 are also possible. For example, the rear panel 30 may include the same combination of an opening and lines of perforations as the front panel 40. In other words, an opening in the rear panel 30 would be defined by an upper edge having a first end and a second end and by a lower edge joined to the first end and the second end of the upper edge of the opening. A line of perforations would extend from the first end of the upper edge of the opening in the rear panel to the line of perforations 21, and a line of perforations would extend from the second end of the upper edge of the opening in the rear panel 30 to line of perforations 51 when the carton is assembled as described above. In addition to the benefits listed above, this would allow the carton 10 to be opened from either the front panel 40 or the rear panel 30. Essentially, the rear panel 30 would look like the front panel 40 in FIG. 3 with the addition of the left rear assembly flap 36. In another version of the carton, the rear tear away section 39 may be omitted such that the carton tear away section 70 comprises the front tear away section 49 and the top 11 of the carton 10.

Although the present invention has been described with reference to certain embodiments, the invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention relates to a carton for containing and displaying a product sold at retail.

I claim:

1. A carton for containing and displaying a product, the carton comprising:

a bottom, a first side, a second side, a front, a top, and a rear, the front having an opening through an interior portion thereof, the bottom, the first side, the second side, the front, the top and the rear collectively defining an interior space of the carton, the first side, the second side, the front, and the rear being joined at their lower edges to at least a portion of the bottom, the front and the rear being joined at their upper edges to at least a portion of the top, the first side being joined at its upper edge to the top by a first line of perforations, the second side being joined at its upper edge to the top by a second line of perforations, the first side and the second side being joined at their front edges to the front, the first side and the second side being joined at their rear edges to the rear, the front including a third line of perforations extending from the opening in the front to the first line of perforations, and a fourth line of perforations extending from the opening in the front to the second line of perforations, the third line of perforations, the fourth line of perforations, the upper edge of the front, and an edge of the opening in the front defining a perimeter of a front tear away section, the rear including a fifth line of perforations extending from the first line of perforations to the second line of perforations, whereby a user can grasp the front tear away section by way of the opening and pull the front tear away section in a first direction up from the front and in a second direction away from the front so as to remove the front tear away section and the top.

2. The carton of claim 1, wherein:

the top comprises a first side flap having opposed ends, a second side flap having opposed ends, a front flap and a rear flap, and the first side flap and the second side flap are arranged in side by side relationship.

3. The carton of claim 1, wherein:

the fifth line of perforations extends from the first line of perforations to an interior portion of the rear and to the second line of perforations, the fifth line of perforations and the upper edge of the rear define the outer boundary of a rear tear away section, and the rear tear away section is removed along with the front tear away section and the top.

4. The carton of claim 1, wherein:

the opening in the front is defined by an upper edge having a first end and a second end and by a lower edge joined to the first end and the second end of the upper edge of the opening, the third line of perforations extends from the first end of the upper edge of the opening to the first line of perforations, and the fourth line of perforations extends from the second end of the upper edge of the opening to the second line of perforations.

5. The carton of claim 4, wherein:

the fifth line of perforations has a shape substantially approximating that of the combination the third line of perforations, the lower edge of the opening in the front and the fourth line of perforations.

6. The carton of claim 4, wherein:

the lower edge of the opening extends downward to a position more than half way down from the upper edge of the front to the lower edge of the front.

7. The carton of claim 4, wherein:

the upper edge of the opening is substantially linear, and the lower edge of the opening is substantially U-shaped.

8. The carton of claim 7, wherein:

the fifth line of perforations has a shape substantially approximating that of the combination the third line of perforations, the lower edge of the opening in the front and the fourth line of perforations.

9. The carton of claim 1, wherein:

the fifth line of perforations extends downward to a position more than half way down from the upper edge of the rear to the lower edge of the rear.

10. The carton of claim 1, wherein:

an opening is arranged in a path of the fifth line of perforations.

11. A one-piece foldable blank for forming the carton of claim 1.

12. A method for forming a display carton, the method comprising:

providing a carton including a bottom, a first side, a second side, a front, a top, and a rear, the front having an opening through an interior portion thereof, the bottom, the first side, the second side, the front, the top and the rear collectively defining an interior space of the carton, the first side, the second side, the front, and the rear being joined at their lower edges to at least a portion of the bottom, the front and the rear being joined at their upper edges to at least a portion of the top, the first side being joined at its upper edge to the top by a first line of perforations, the second side being joined at its upper edge to the top by a second line of perforations, the first side and the second side being joined at their front edges to the front, the first side and the second side being joined at their rear edges to the rear, the front including a third line of perforations extending from the opening in the front to the first line of perforations, and a fourth line of perforations extending from the opening in the front to the second line of perforations, the third line of perforations, the fourth line of perforations, the upper edge of the front, and an edge of the opening in the front defining a perimeter of a front tear away section, the rear including a fifth line of perforations extending from the first line of perforations to the second line of perforations;

grasping the front tear away section by way of the opening; and pulling the front tear away section in a first direction up from the front and in a second direction away from the front so as to remove the front tear away section and the top to form the display carton.

13. The method of claim 12, wherein:

the fifth line of perforations extends from the first line of perforations to an interior portion of the rear and to the second line of perforations, the fifth line of perforations and the upper edge of the rear define the outer boundary of a rear tear away section, and the rear tear away section is removed from the carton along with the front tear away section and the top.

14. A display carton formed by the method of claim 12.

* * * * *